US011504768B2

(12) United States Patent
Lagerbom et al.

(10) Patent No.: US 11,504,768 B2
(45) Date of Patent: Nov. 22, 2022

(54) METHOD FOR PRODUCING HARD METAL POWDER, AND HARD METAL POWDER

(71) Applicant: TEKNOLOGIAN TUTKIMUSKESKUS VTT OY, Espoo (FI)

(72) Inventors: Juha Lagerbom, Tampere (FI); Marjaana Karhu, Tampere (FI); Hanna-Mari Sinilehto, Tampere (FI); Ulla Kanerva, Tampere (FI)

(73) Assignee: TEKNOLOGIAN TUTKIMUSKESKUS VTT OY, Espoo (FI)

( * ) Notice: Subject to any disclaimer, the term of this patent is extended or adjusted under 35 U.S.C. 154(b) by 346 days.

(21) Appl. No.: 16/486,581

(22) PCT Filed: Feb. 16, 2018

(86) PCT No.: PCT/FI2018/050116
§ 371 (c)(1),
(2) Date: Aug. 16, 2019

(87) PCT Pub. No.: WO2018/150100
PCT Pub. Date: Aug. 23, 2018

(65) Prior Publication Data

US 2020/0230702 A1 Jul. 23, 2020

(30) Foreign Application Priority Data

Feb. 17, 2017 (FI) ..... 20175140

(51) Int. Cl.
*B22F 9/02* (2006.01)
*B22F 1/10* (2022.01)
(Continued)

(52) U.S. Cl.
CPC ..... *B22F 9/026* (2013.01); *B22F 1/10* (2022.01); *B22F 1/148* (2022.01);
(Continued)

(58) Field of Classification Search
CPC .. B22F 9/026; B22F 1/10; B22F 1/148; B22F 2009/041; B22F 2009/043;
(Continued)

(56) References Cited

U.S. PATENT DOCUMENTS 6,293,989 B1 * 9/2001 Kim ..... C22C 1/055 75/351
2001/0004473 A1 * 6/2001 Strutt et al. ..... C23C 4/04 427/446
2003/0075012 A1 4/2003 Knunz et al.

FOREIGN PATENT DOCUMENTS

CN 101811195 8/2010
CN 105648383 6/2016
(Continued)

OTHER PUBLICATIONS

Translation CN 105648383 A (Year: 2016).*
(Continued)

*Primary Examiner* — Brian D Walck
*Assistant Examiner* — Danielle Carda
(74) *Attorney, Agent, or Firm* — Nixon & Vanderhye PC

(57) ABSTRACT

A method for producing hard metal powder suitable for manufacturing hard metal products including metal carbides and a binder is provided. An easy to carry out method that provides high quality hard metal powder includes: a) dissolving in water, water soluble raw materials and a binder source to form an aqueous solution, b) drying the aqueous solution to form a precursor powder having the raw materials homogenously distributed throughout the precursor powder, c) decomposing the precursor powder by heating
(Continued)

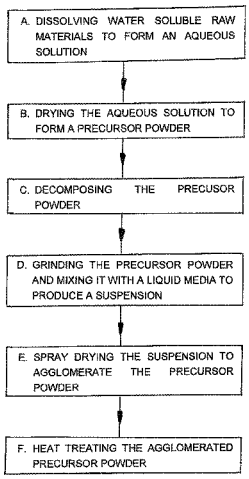

the powder in an inert atmosphere to remove gas evolved in the decomposition of the raw materials, d) grinding the precursor powder and mixing it with a liquid media to produce a suspension, e) spray drying the suspension to agglomerate the precursor powder, and f) heat treating the agglomerated precursor powder to form a hard metal powder containing agglomerates of carbides evenly distributed and bonded to a metallic matrix.

17 Claims, 1 Drawing Sheet

(51) Int. Cl.
*B22F 1/148* (2022.01)
*B22F 9/04* (2006.01)
*B22F 9/08* (2006.01)

(52) U.S. Cl.
CPC ... *B22F 2009/041* (2013.01); *B22F 2009/043* (2013.01); *B22F 2009/0804* (2013.01); *B22F 2201/016* (2013.01); *B22F 2201/05* (2013.01); *B22F 2201/11* (2013.01); *B22F 2201/50* (2013.01); *B22F 2301/15* (2013.01); *B22F 2301/20* (2013.01); *B22F 2301/35* (2013.01); *B22F 2304/10* (2013.01)

(58) Field of Classification Search
CPC ..... B22F 2009/0804; B22F 2201/016; B22F 2201/05; B22F 2201/11; B22F 2201/50; B22F 2301/15; B22F 2301/20; B22F 2301/35; B22F 2304/10
USPC ..... 75/255
See application file for complete search history.

(56) References Cited

FOREIGN PATENT DOCUMENTS

| | | |
|---|---|---|
| WO | 83/01917 | 6/1983 |
| WO | 2013/178804 | 12/2013 |

OTHER PUBLICATIONS

Ulla Kanerva et al., "Chemical synthesis of WC-Co from water-soluble precursors: The effect of carbon and cobalt additions to WC synthesis", International Journal of Refractory Metals and Hard Materials, Dec. 18, 2015, vol. 56, pp. 69-75.
FI Search Report of FI Patent Application No. 20175140 dated Jun. 16, 2017, 1 page.
International Search Report for PCT/FI2018/050116 dated May 8, 2018, 3 pages.
Written Opinion of the ISA for PCT/FI2018/050116 dated May 8, 2018, 8 pages.

* cited by examiner

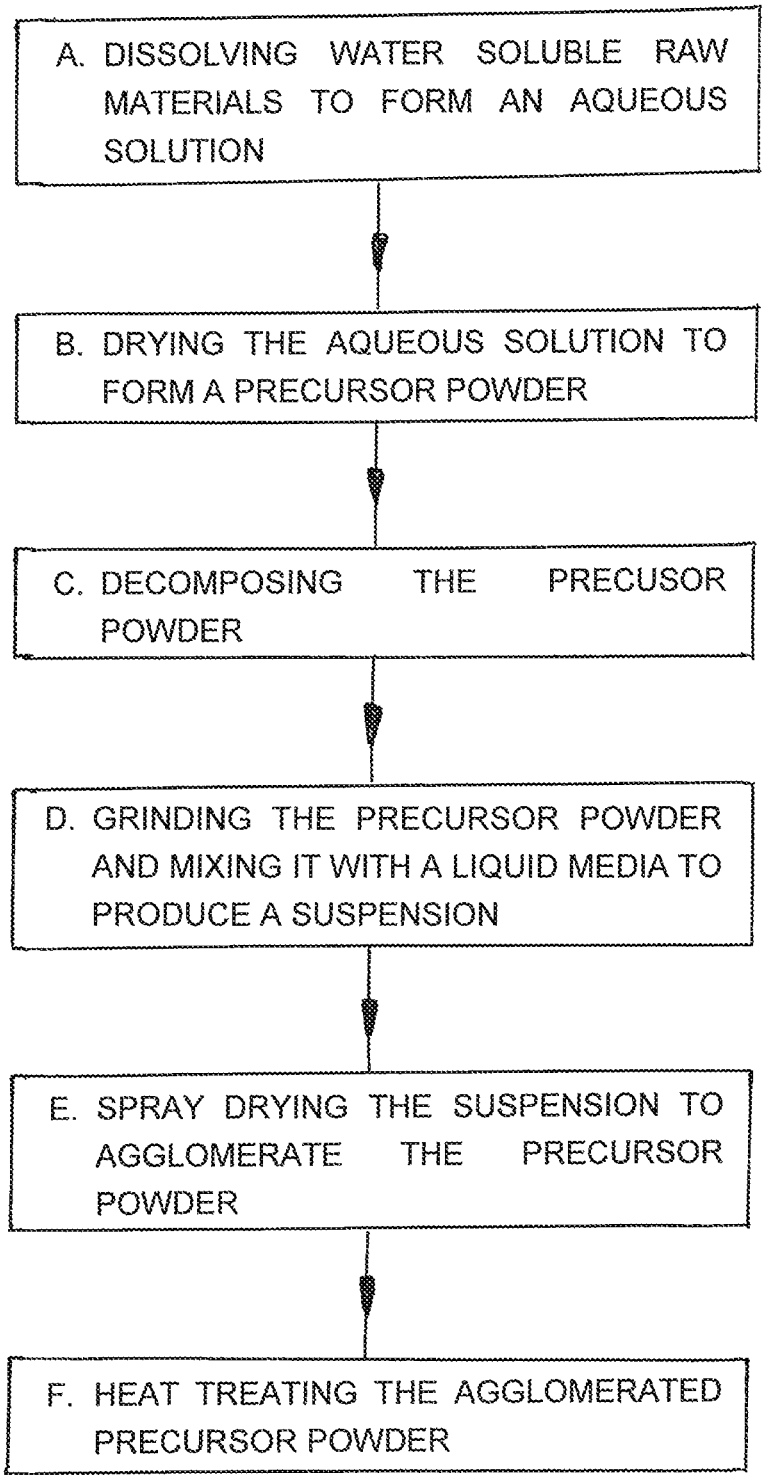
A. DISSOLVING WATER SOLUBLE RAW MATERIALS TO FORM AN AQUEOUS SOLUTION
B. DRYING THE AQUEOUS SOLUTION TO FORM A PRECURSOR POWDER
C. DECOMPOSING THE PRECUSOR POWDER
D. GRINDING THE PRECURSOR POWDER AND MIXING IT WITH A LIQUID MEDIA TO PRODUCE A SUSPENSION
E. SPRAY DRYING THE SUSPENSION TO AGGLOMERATE THE PRECURSOR POWDER
F. HEAT TREATING THE AGGLOMERATED PRECURSOR POWDER

METHOD FOR PRODUCING HARD METAL POWDER, AND HARD METAL POWDER

This application is the U.S. national phase of International Application No. PCT/FI2018/050116 filed Feb. 16, 2018 which designated the U.S. and claims priority to FI Patent Application No. 20175140 filed Feb. 17, 2017, the entire contents of each of which are hereby incorporated by reference.

FIELD OF THE INVENTION

The invention relates to method for producing hard metal powder suitable for manufacturing hard metal products comprising metal carbides and a metallic binder. The expression "hard metal powder" refers here to a powder comprising fine hard particles of carbide and a binder metal. The hard metal powder can especially be used for providing products with a wear resistant coating.

BACKGROUND OF THE INVENTION

Hard metal powders can be manufactured in multitude manners. Various chemical agents, machines and devices are typically used in the manufacturing processes of the powders.

Desirable is to have a manufacturing process which is easy to carry out and which provides a hard metal powder which has high quality and can be readily used e.g. for spraying a hard metal coating on a product. Known manufacturing processes do not fulfil these requirements in all respects, they require e.g. chemicals, such as reducing agents to prevent undesired oxidation; alternatively oxidation can be prevented by carrying out method steps in a non-oxidizing environment. Preventing undesired oxidation typically makes the manufacturing process complicated and expensive. A conventional process for making agglomerated hard metal powders includes a synthesis which is carried out separately from a spray drying of the completed mixture comprising carbides and a metal matrix (binder). US 20030075012 A1 discloses a method for producing a refractory hard metal powder comprising milling a slurry formed of carbide powder, powdered metallic binder and water; subsequently mixing pressing aid components, in the form of a wax emulsion with the slurry; and drying the slurry to form the hard metal powder.

BRIEF DESCRIPTION OF THE INVENTION

An object of the present invention is to provide a method for producing hard metal powder, which method is easy to carry out and which provides hard metal powder having high quality and nano sized or fine sized carbides.

This object of the invention is achieved by a method comprising the steps of a) dissolving in water water soluble raw materials comprising a hard particle source and a metallic binder source to form an aqueous solution, b) drying in a drying process the aqueous solution to form a precursor powder having the raw materials homogenously distributed throughout the precursor powder, c) decomposing the precursor powder in a first heat treatment step by heating it in a temperature of 370° C. to 430° C. in an inert atmosphere to remove gas evolved in the decomposition of the raw materials, d) grinding the precursor powder and mixing it with a liquid media to produce a suspension, e) spray drying the suspension to agglomerate the precursor powder, and f) heat treating the agglomerated precursor powder in a second heat treatment step at 900° C. to 1150° C. in an inert atmosphere to form a hard metal powder containing agglomerates of carbides evenly distributed and bonded to a metallic matrix. Preferred embodiments of the invention are disclosed in the dependent claims.

The carbides in the agglomerates in step f) are fine sized, preferably nano sized.

An essential feature of the invention is that two drying steps, preferably spray drying steps, are carried out between which drying steps an intermediate first heat treatment step is carried out. In the method of the invention, a nano carbide synthesis and an in-situ matrix takes place in the form of an agglomerate. Thus, in the invention, the carbide synthesis step and in-situ matrix take place in the heat treating of the agglomerated powder. Thus conventional separate synthesis and a spray drying of a finished carbide-metal matrix solution is not made for producing the agglomerated hard metal powder. In the invention there is no need to deal with separate nanoparticles when the carbides are bonded to the metallic matrix in the form of agglomerates, providing thus health and safety advantages.

During drying of the suspension, the powder is not oxidized, because it is already in an oxidized state prior to the drying of the suspension, and this enables to use preferably hot air for drying. Thus, reducing agent is not needed in hot gas drying with air, neither is an inert gas needed for the hot gas drying. In the hard metal powder, the binder is homogenously mixed with the metal carbides providing a dense powder. The powder is readily usable and has good flowability. The hard metal powder has a nanostructure and it is easy to control the composition of the hard metal powder. The expression nanostructure refers in this invention to carbides. The hard metal powder produced by the method is readily usable and has good flowability; it can be used for manufacturing wear resistant powder metallurgy products and coatings. A multitude of manufacturing techniques are available for manufacturing the products and coatings, e.g. thermal spraying including additive manufacturing. More conventional manufacturing techniques include e.g. sintering in a mold.

BRIEF DESCRIPTION OF THE DRAWINGS

In the following the invention will be described in greater detail by means of a preferred embodiment with reference to the attached drawing, where the main steps of the invention have been presented in a general form.

DETAILED DESCRIPTION OF THE INVENTION

The attached FIGURE shows the main steps of the method of the invention for producing hard metal powder. The expression "hard metal powder" refers here to a powder comprising fine hard particles of carbide and a binder metal. Typically, the hard particles of carbide are WC, and the binder metal is typically Co. As the FIGURE tells, the steps for producing hard metal powder are: a) dissolving in water water soluble raw materials comprising a hard particle source and a metallic binder source to form an aqueous solution, b) drying in a drying process the aqueous solution to form a precursor powder having the raw materials homogenously distributed throughout the precursor powder, c) decomposing the precursor powder in a first step by heating it in a temperature of 370° C. to 430° C. in an inert atmosphere to remove gas evolved in the decomposition of the raw materials, d) grinding the precursor powder and mixing it with a liquid media to produce a suspension, e) spray drying the suspension to agglomerate the precursor powder, and f) heat treating the agglomerated precursor powder at 900° C. to 1150° C. in an inert atmosphere to form a hard metal powder containing agglomerates of carbides evenly distributed and bonded to a metallic matrix.

The hard particle source in step a) above comprises in addition to carbon (C) one or more of the chemical elements W, Cr, V, Ti, Zr, Mo, Ta, and Nb. Glycine, $C_2H_5NO_2$, is preferably chosen as the carbon source. If the hard particle source comprises wolfram (W), ammonium meta tungstate, $(NH_4)_6H_2W_{12}O_{40}.H_2O$, is preferably chosen as the W source.

The binder source in step a) above preferably comprises one or more of the chemical elements Co, Cr, Ni and Fe. If the binder source comprises Co, cobalt acetate, $Co(C_2H_3O_2)_2.H_2O$, (or $C_4H_6CoO_4$), is preferably chosen as the binder source.

The drying process of the aqueous solution in step b) is preferably carried out by spray drying in hot gas, preferably in hot air having a temperature preferably above 100° C. Spray drying is an efficient process for producing a homogenous solution.

The gas removed in the decomposing of the precursor powder in step c) is preferably $NH_3$ and $H_2O$, and removing these gases will reduce 30% of the mass of the precursor powder.

A ball mill is preferably used for grinding the precursor powder in step d). Preferably, the precursor powder is grinded when being mixed with the liquid media.

The liquid media used in step d) to produce a suspension, is preferably water or ethanol.

The spray drying of the suspension in step e) is preferably carried out with a hot gas without the use of a reducing agent and preferably using a hot air dryer. A reducing agent is not needed in the present invention, because the substances of the suspension are in a state which does not react with oxygen. Thus, air can be used as the hot gas in the dryer.

Nano carbide synthesis takes place in step f). The inert atmosphere for heat treating the agglomerated powder in step f) is preferably argon. Preferably, the inert gas can alternatively be i) a mixture of argon and hydrogen, preferably 96-98% Ar, the rest (2-4%) Hz; ii) nitrogen; or iii) a mixture of nitrogen and hydrogen, preferably 96-98% $N_2$, the rest (2-4%) $H_2$. Gas evolved in decomposition reactions in the step f) is small enough to prevent agglomerates to break up. The powder formed can, as such safely be handled and used for various applications.

The total weight loss is roughly 70%, typically 60% to 80%, when the nano carbide synthesis is made with water soluble raw materials. The size of the agglomerates in step f) is preferably 5 μm to 50 μm, more preferably 10 μm to 40 μm and even more preferably 20 μm to 30 μm. A size of 20 μm to 30 μm is applicable for most applications. The distribution of the binder in the nanoparticles is homogenous in the hard metal powder produced by the method of the invention. The size of the carbides (typically WC) defines the hard metal powder produced by the method of the invention to be a nanomaterial.

It will be obvious to a person skilled in the art that, as the technology advances, the inventive concept can be implemented in various ways. The detailed description does not limit the invention. The invention may in its details vary within the scope of the claims.

The invention claimed is:

1. A method for producing hard metal powder suitable for manufacturing hard metal products comprising metal carbides and a metallic binder, the method comprising:

a) dissolving water soluble raw materials in water comprising a hard particle source, comprising a carbon source, and a metallic binder source to form an aqueous solution, b) drying in a drying process the aqueous solution to form a precursor powder having the water soluble raw materials homogenously distributed throughout the precursor powder, c) decomposing the precursor powder in a first heat treatment by heating it in a temperature of 370° C. to 430° C. in an inert atmosphere to remove gas evolved in the decomposition of the water soluble raw materials, d) grinding the precursor powder and mixing it with a liquid media to produce a suspension, e) spray drying the suspension to agglomerate the precursor powder, and f) heat treating the agglomerated precursor powder in a second heat treatment at 900° C. to 1150° C. in an inert atmosphere to form a hard metal powder containing agglomerates of carbides evenly distributed and bonded to a metallic matrix, wherein (f) is carried out immediately after (e).

2. The method according to claim 1, wherein the hard particle source in (a) comprises, in addition to C, one or more of the chemical elements W, Cr, V, Ti, Zr, Mo, Ta, and Nb.

3. The method of claim 1, wherein the hard particle source in (a) comprises ammonium meta tungstate forming a W (wolfram) source.

4. The method of claim 1, wherein the metallic binder source in (a) comprises one or more of chemical elements Co, Cr, Ni, and Fe.

5. The method of claim 1, wherein the hard particle source in (a) comprises glycine forming a C (carbon) source.

6. The method of claim 1, wherein the metallic binder source in (a) comprises cobalt acetate forming a Co (cobalt) source.

7. The method of claim 1, wherein the drying process in (b) is a spray drying process carried out in a hot gas.

8. The method of claim 1, wherein the gas removed in (c) comprises $NH_3$ and $H_2O$.

9. The method of claim 1, wherein the precursor powder is grinded in (d) in a ball mill.

10. The method of claim 9, wherein the liquid media in (d) is water.

11. The method of claim 9, wherein the liquid media in (d) is ethanol.

12. The method of claim 1, wherein the liquid media in (d) is water.

13. The method of claim 1, wherein the liquid media in (d) is ethanol.

14. The method of claim 1, wherein the spray drying in (e) is carried out in hot gas without a reducing agent.

15. The method of claim 14, wherein the hot gas in (e) is air.

16. The method of claim 1, wherein the inert atmosphere in (f) is argon.

17. The method of claim 1, wherein the agglomerates of carbides in (f) have a size of 5 μm to 50 μm.

* * * * *